US012630332B2

(12) United States Patent
Bonilla et al.

(10) Patent No.: US 12,630,332 B2
(45) Date of Patent: May 19, 2026

(54) PALLET CONTAINER SYSTEM

(71) Applicants: Billy Bonilla, Niceville, FL (US); Amil Álvarez, Auburndale, FL (US)

(72) Inventors: Billy Bonilla, Niceville, FL (US); Amil Álvarez, Auburndale, FL (US)

( * ) Notice: Subject to any disclaimer, the term of this patent is extended or adjusted under 35 U.S.C. 154(b) by 0 days.

(21) Appl. No.: 18/235,155

(22) Filed: Aug. 17, 2023

(65) Prior Publication Data

US 2024/0059454 A1 Feb. 22, 2024

Related U.S. Application Data

(60) Provisional application No. 63/398,718, filed on Aug. 17, 2022.

(51) Int. Cl.
*B65D 21/02* (2006.01)
*B65D 19/00* (2006.01)
(Continued)

(52) U.S. Cl.
CPC ..... *B65D 21/0204* (2013.01); *B65D 19/00* (2013.01); *B65D 21/0219* (2013.01); *B65D 21/0223* (2013.01); *B65D 25/04* (2013.01); *B65D 25/205* (2013.01); *B65D 25/24* (2013.01); *B65D 25/28* (2013.01); *B65D 25/2841* (2013.01); *B65D 43/16* (2013.01); *B65D 2203/02* (2013.01); *B65D 2525/287* (2013.01); *B65D 2543/00194* (2013.01); *B65D 2543/00296* (2013.01)

(58) Field of Classification Search
CPC .... B65D 21/0219; B65D 21/0204; B62B 3/16
See application file for complete search history.

(56) References Cited

U.S. PATENT DOCUMENTS 4,890,705 A * 1/1990 Pineda ..... A45C 13/262 190/110
5,186,330 A * 2/1993 McClure ..... B62B 3/16 206/508

(Continued)

OTHER PUBLICATIONS

Merriam-Webster. (n.d.). Contiguous. In Merriam-Webster.com dictionary. Retrieved Jul. 25, 2025, from https://www.merriam-webster.com/dictionary/contiguous.

*Primary Examiner* — Mollie Impink
(74) *Attorney, Agent, or Firm* — Verrill Dana, LLP

(57) ABSTRACT

A pallet system having a plurality of like boxes which are sized and configured to a fit on a standardized air cargo pallet such as a U.S. Air Force 463L pallet. Each box has four sides and a hinged lid and is typically formed of a plastic material. The lid has a configuration that mates with the configuration of other like boxes such that boxes can be stacked on top of each other and be nested together without falling off. Each box also contains a first latch element which is mateable with a second latch element on an adjacent like box to fasten the boxes together in a horizontal direction on the pallet. A box may contain interior separators or compartments to suit size and content requirements. A box may be constructed to function for a particular purpose in addition to storage and shipping. Suitable labels and identifications can be applied to a box for each of identification in an inventory control system which may be implemented in an App for a mobile phone.

9 Claims, 14 Drawing Sheets

(51) Int. Cl.

| | |
|---|---|
| ***B65D 25/04*** | (2006.01) |
| ***B65D 25/20*** | (2006.01) |
| ***B65D 25/24*** | (2006.01) |
| ***B65D 25/28*** | (2006.01) |
| ***B65D 43/16*** | (2006.01) |

(56) References Cited

U.S. PATENT DOCUMENTS

| | | | | |
|---|---|---|---|---|
| 5,445,397 | A * | 8/1995 | Evans | B62B 1/10 206/508 |
| 6,116,390 | A * | 9/2000 | Cohen | A45C 5/14 190/115 |
| 6,857,535 | B1 * | 2/2005 | Zuckerman | B65D 71/0096 220/23.6 |
| 8,573,399 | B2 * | 11/2013 | Ulmer | B65D 43/0206 206/508 |
| 8,960,469 | B1 * | 2/2015 | Helal | B65B 5/04 206/508 |
| 10,442,568 | B1 * | 10/2019 | Summers | B65D 55/10 |
| 10,843,852 | B2 * | 11/2020 | Reinhart | B65D 43/0202 |
| 2013/0056462 | A1 * | 3/2013 | Furuta | B65D 21/0212 220/23.4 |
| 2017/0313334 | A1 * | 11/2017 | Ryan | B65D 25/30 |
| 2024/0199297 | A1 * | 6/2024 | Seibold | B62B 1/12 |

* cited by examiner

Right side of box with pulling handle located at the bottom of the box.

Box in open configuration with visible grate on the bottom.

Open box with handle extended and interior dividers.

PALLET CONTAINER SYSTEM

CROSS-REFERENCE TO RELATED APPLICATIONS

This application claims priority from U.S. Provisional Patent application No. 63/398,718 filed Aug. 17, 2022 titled PALLET CONTAINER SYSTEM, which application is fully incorporated herein by reference.

BACKGROUND OF THE INVENTION

Standardized pallet systems are often employed by the U.S. military and other allied countries to store and transport cargo on military aircraft. A well-known pallet system is known as the 463L pallet system which is widely employed and subject of Department of Defense ("DOD") regulations and standards.

Although widely utilized, this system does not have the versatility often required by customers and is limited in its deployment by fixed dimensions and other features which limit its applicability and usefulness.

SUMMARY

The boxes are designed to be employed with a standard Air Force 463L pallet system for use on military cargo aircraft such as the C130 and C17.

Each box is sized to maximize use of the pallet and to mate with like boxes to provide an array or plurality of box units of intended length, width and height.

Each box is constructed to sit on top of a similar box and be fitted thereto so as not to slide off.

Thus, the boxes can be aligned in a vertical or stacked direction to an intended height. Each box also contains fittings which permit the box to be latched side-to-side with like boxes, and thus the boxes can be latched laterally along the length and width of a stack of boxes and stay together as a unit. The boxes can be further retained when stacked by a cargo net which per se can be a standard cargo net.

Each box is constructed of plastic material and is typically of molded construction, but not limited to such construction.

DESCRIPTION OF THE DRAWINGS

The invention will be more fully understood from the following detailed description, in conjunction with the drawings in which.

DETAILED DESCRIPTION

Figure 1:
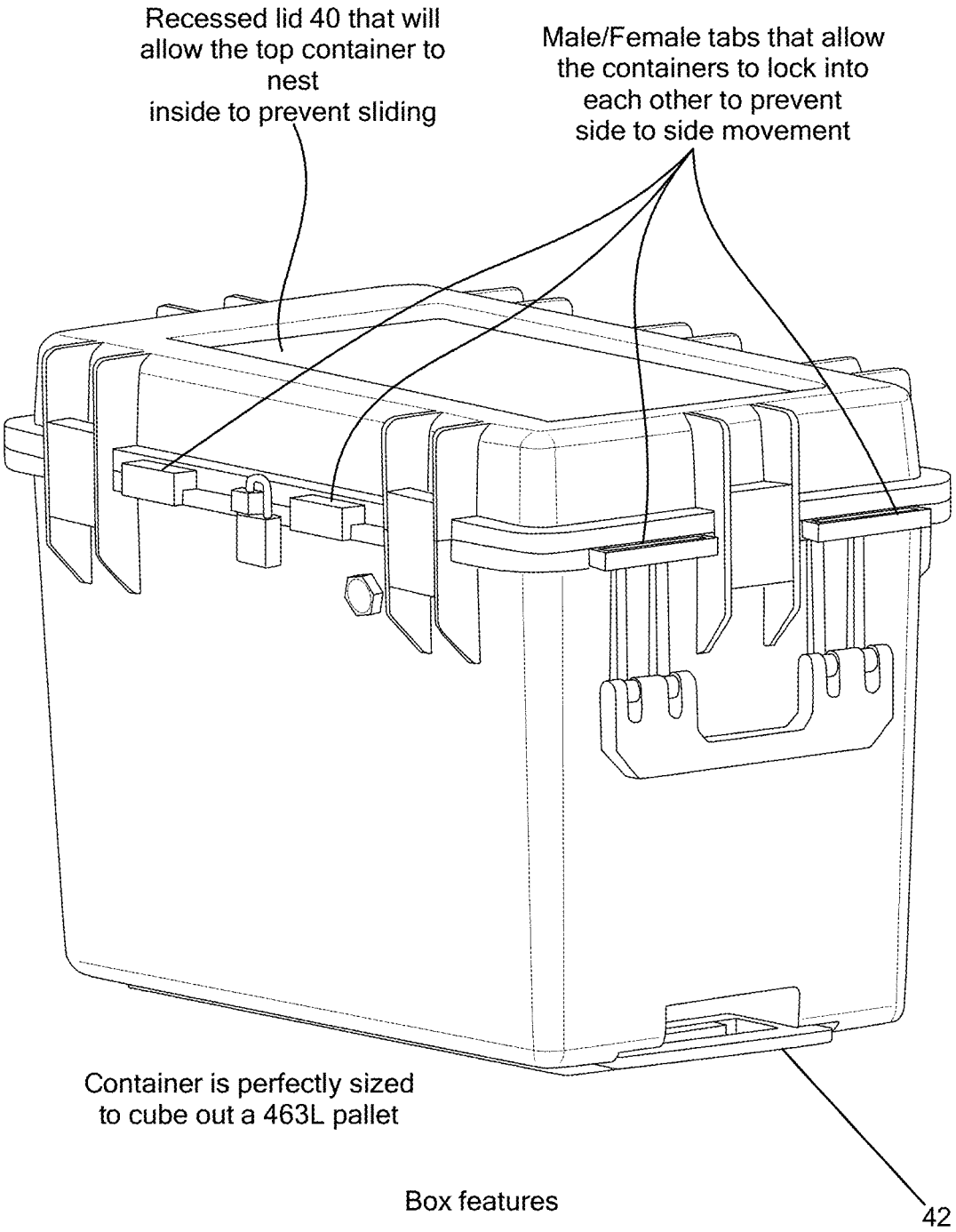
FIG. 1 is a pictorial view of a container or box in accordance with the invention.
Figure 2A:
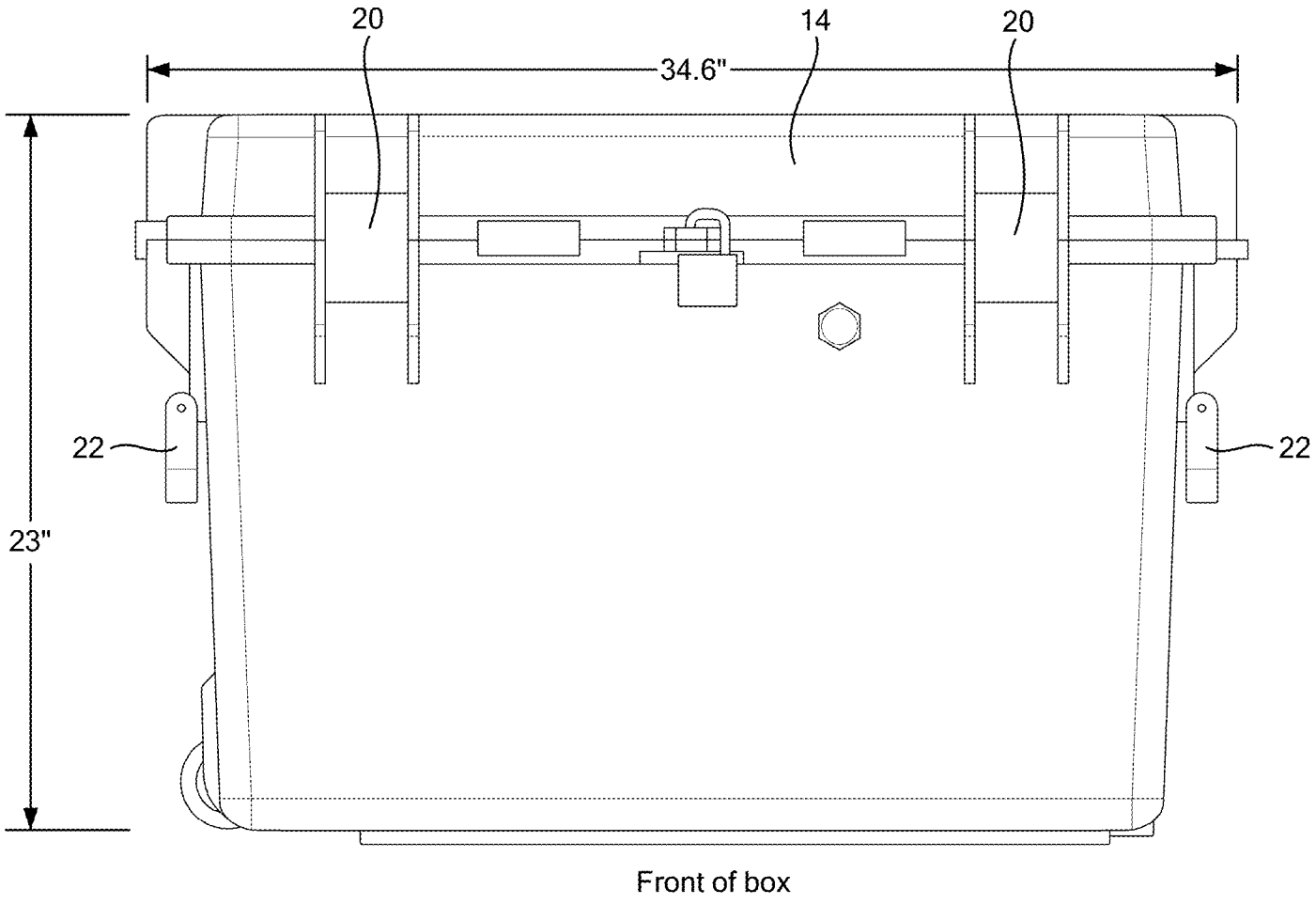
FIG. 2A is a front elevation view of the front of the container of FIG. 1.
Figure 2B:
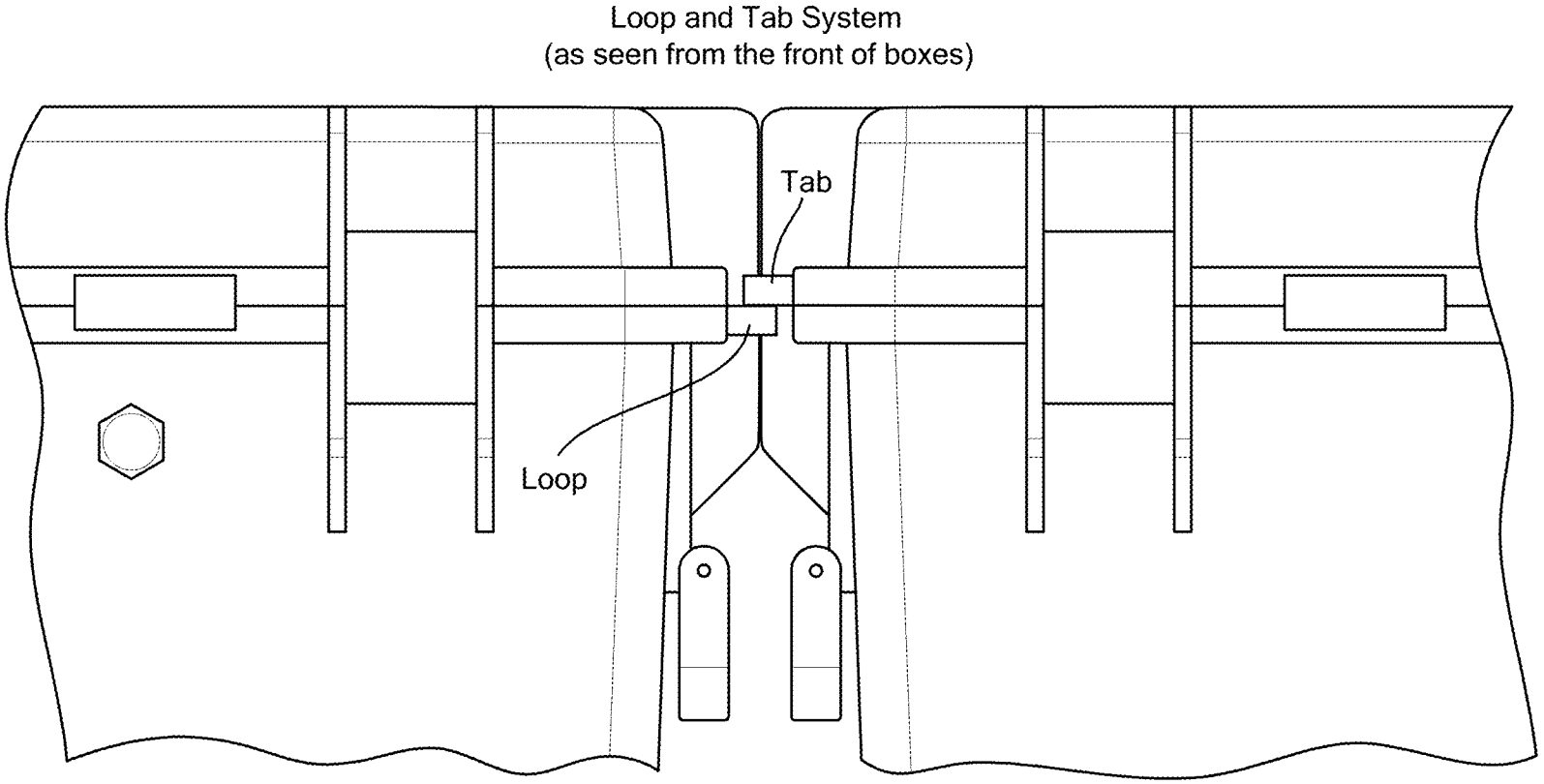
FIG. 2B is an elevation view of two like containers interconnected side-by-side.
Figure 2C:
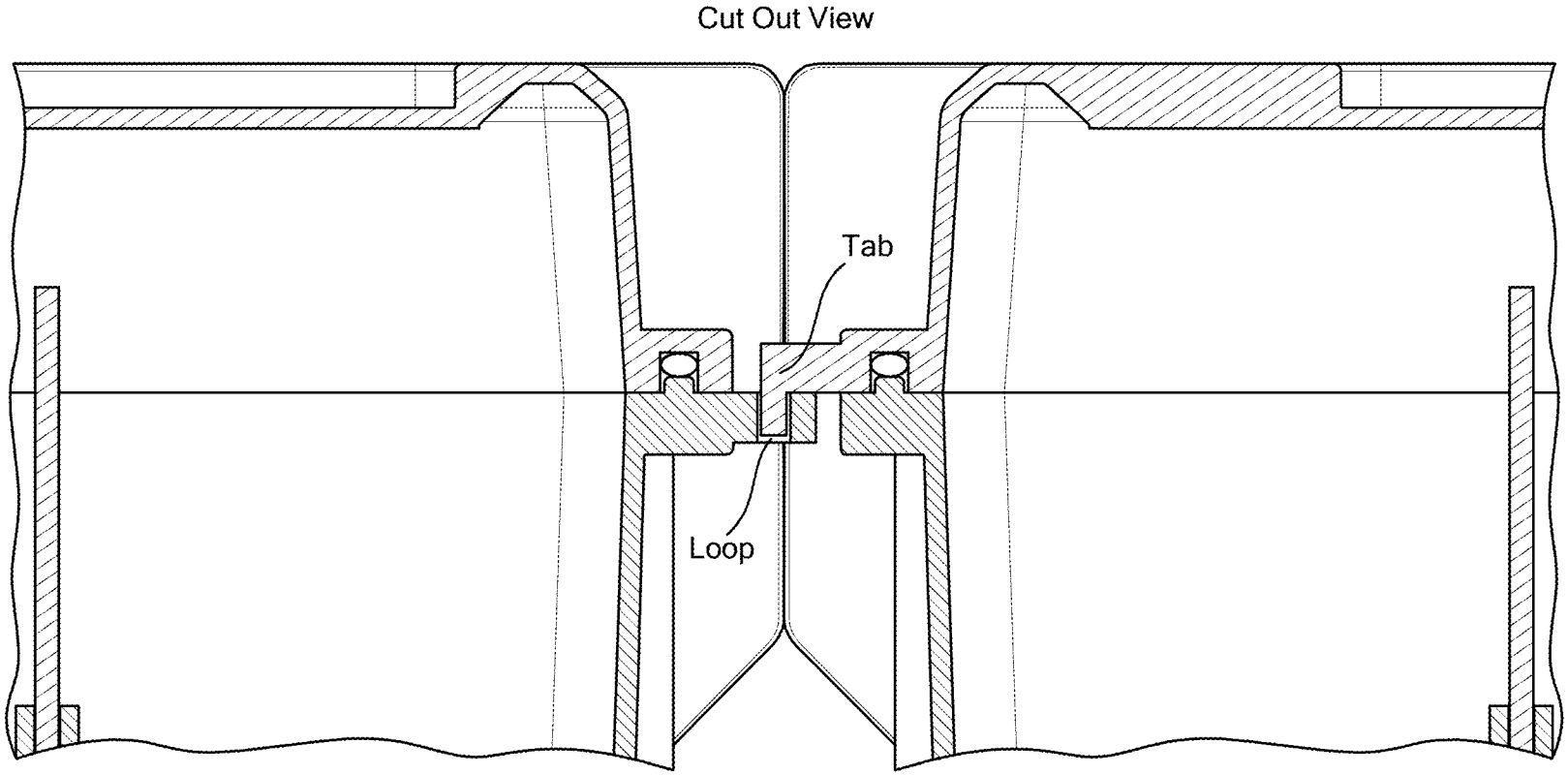
FIG. 2C is a partially cutaway elevation view of the containers of FIG. 2B illustrating the interlocking mechanism.
Figure 2D:
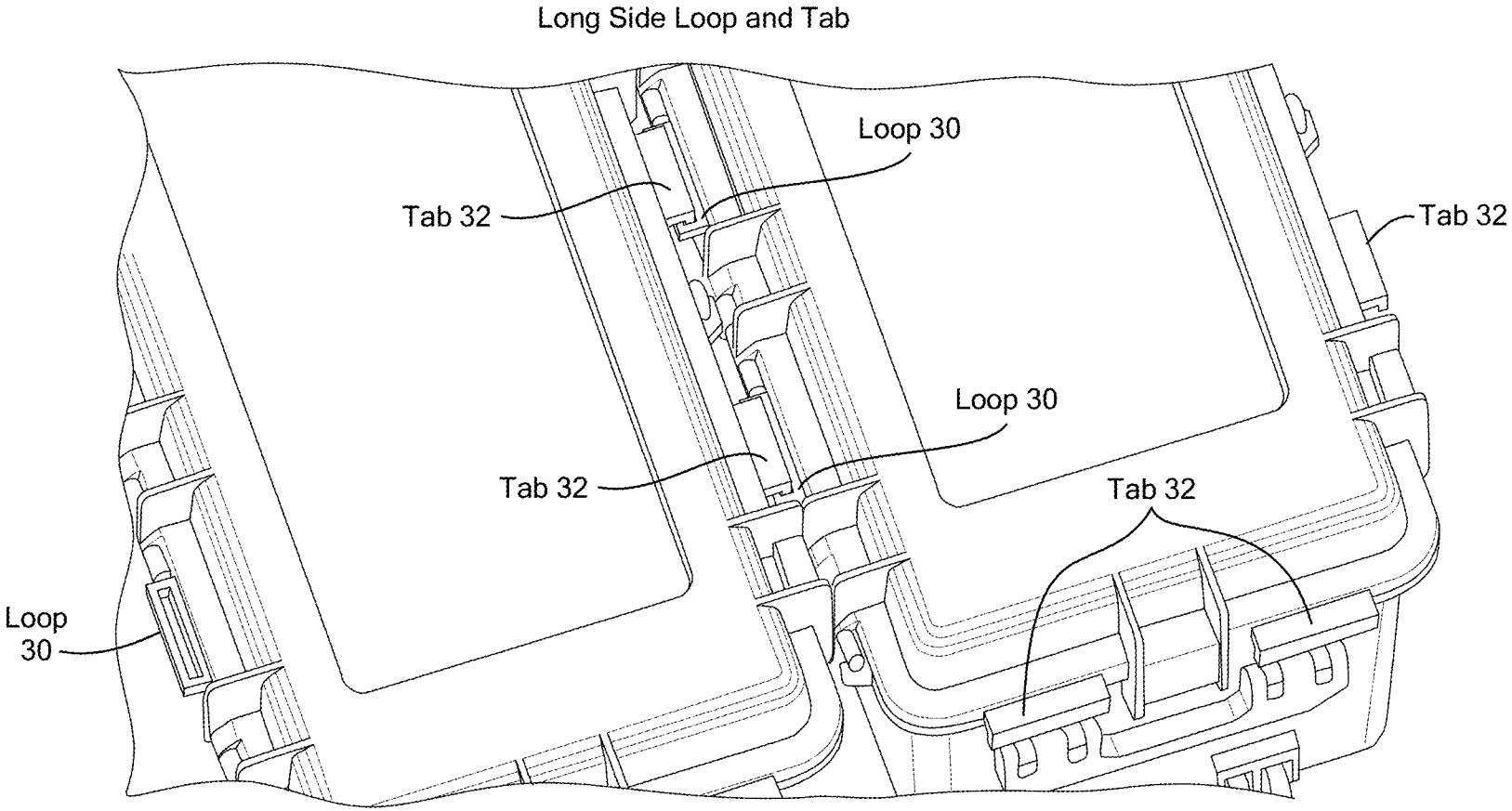
FIG. 2D is a top pictorial view of two interconnected containers.
Figure 2E:
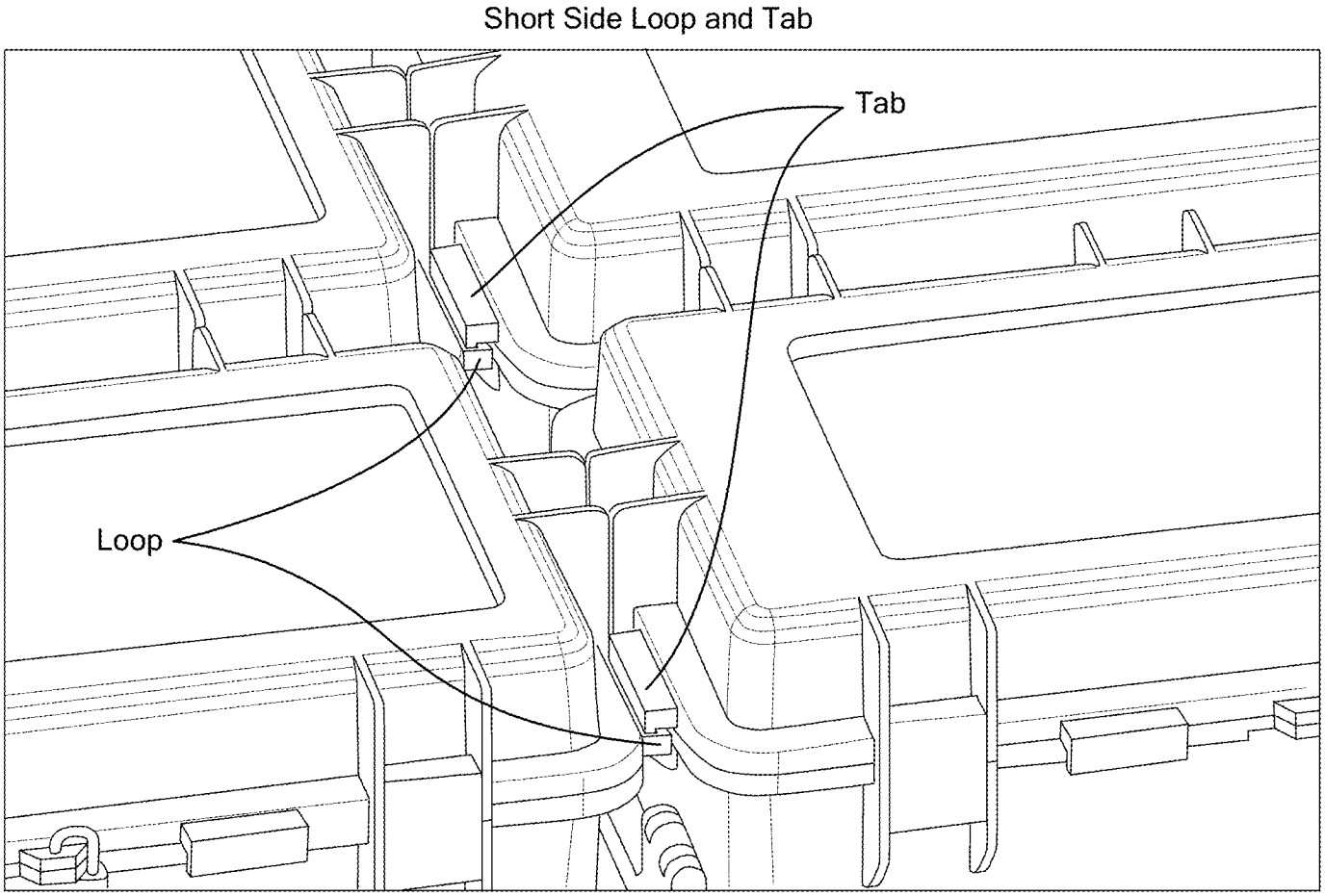
FIG. 2E is a top pictorial view of four interconnected containers.
Figure 2F:
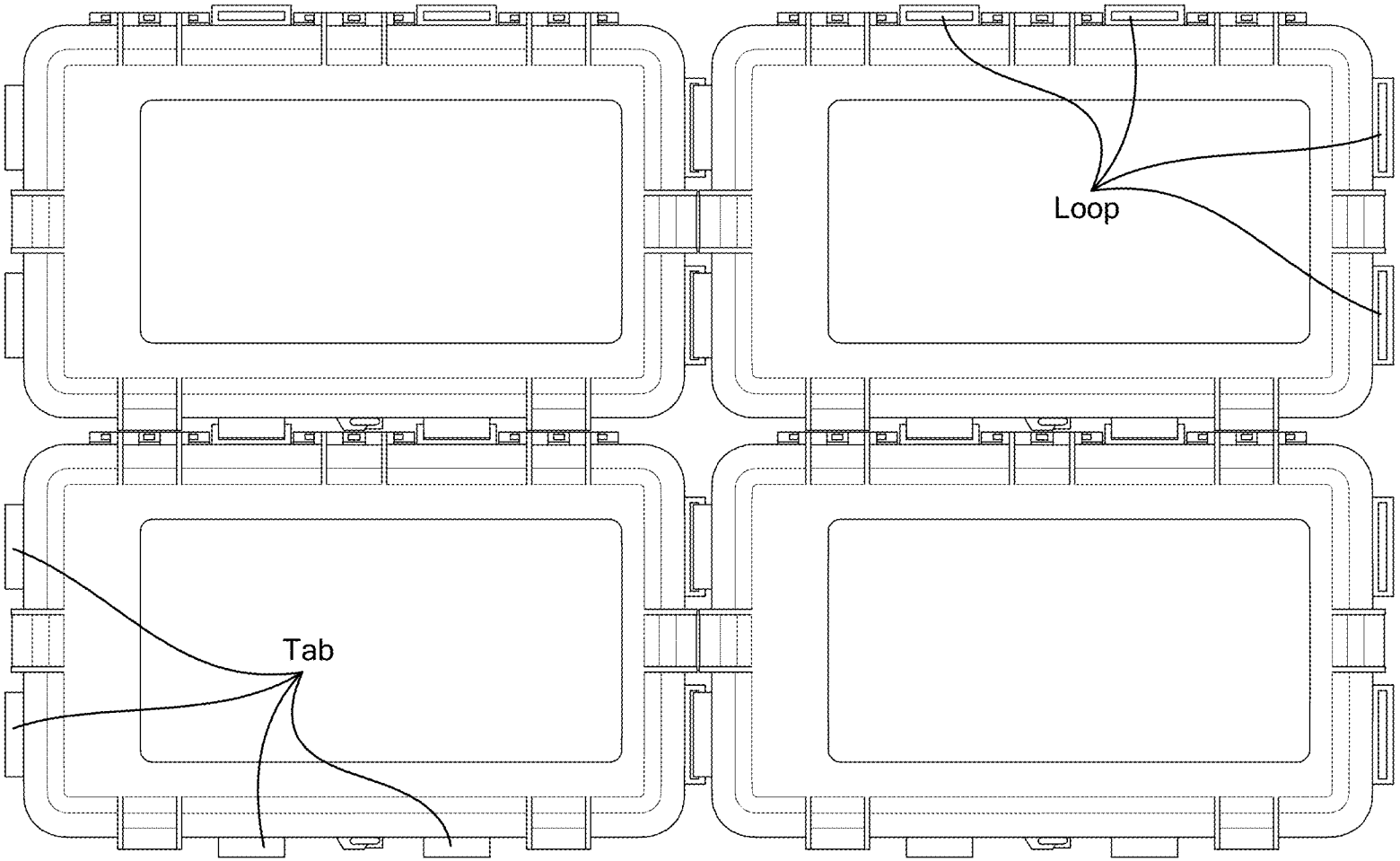
FIG. 2F is a top view of interconnected containers.
Figure 3:
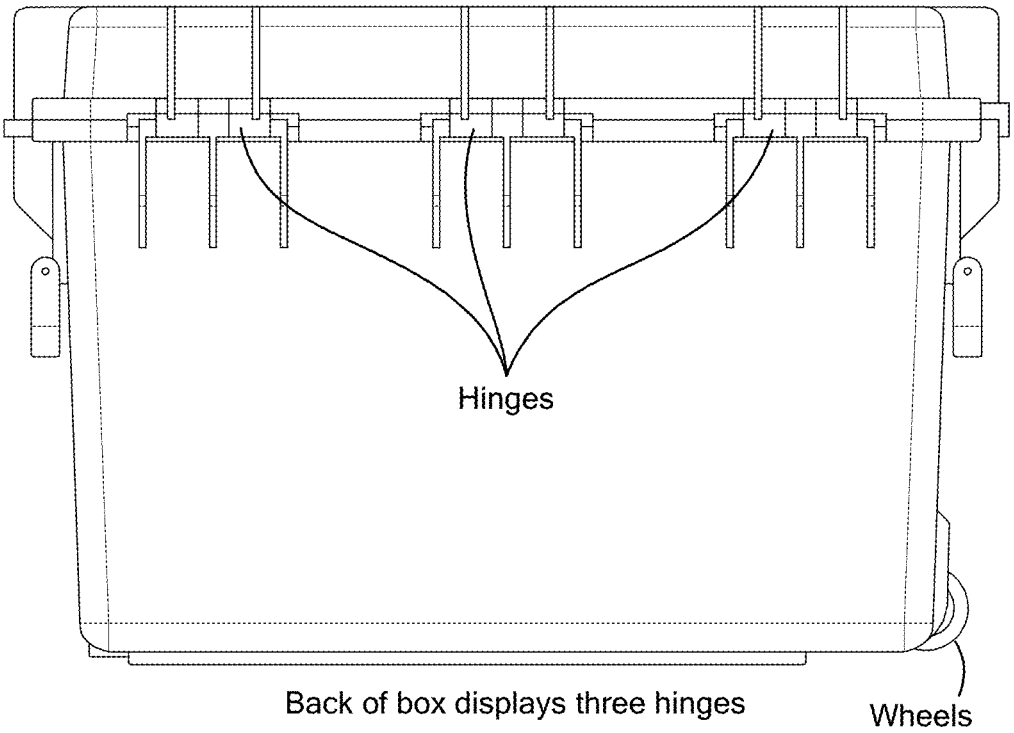
FIG. 3 is an elevation view of the back of the container of FIG. 1.
Figure 4:
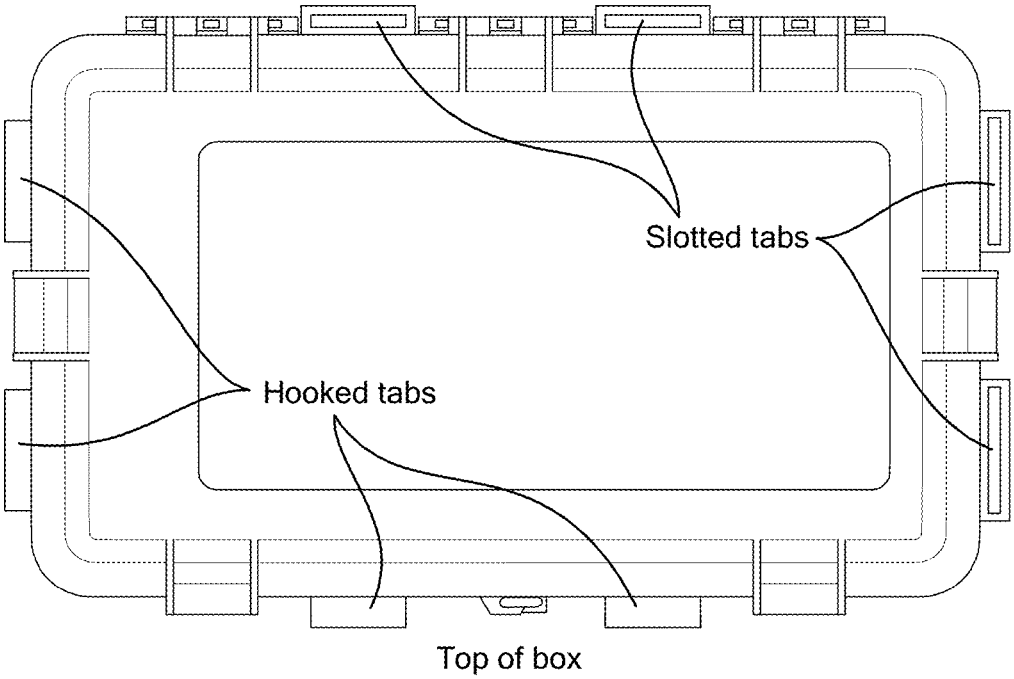
FIG. 4 is a top view of the container of FIG. 1.
Figure 5:
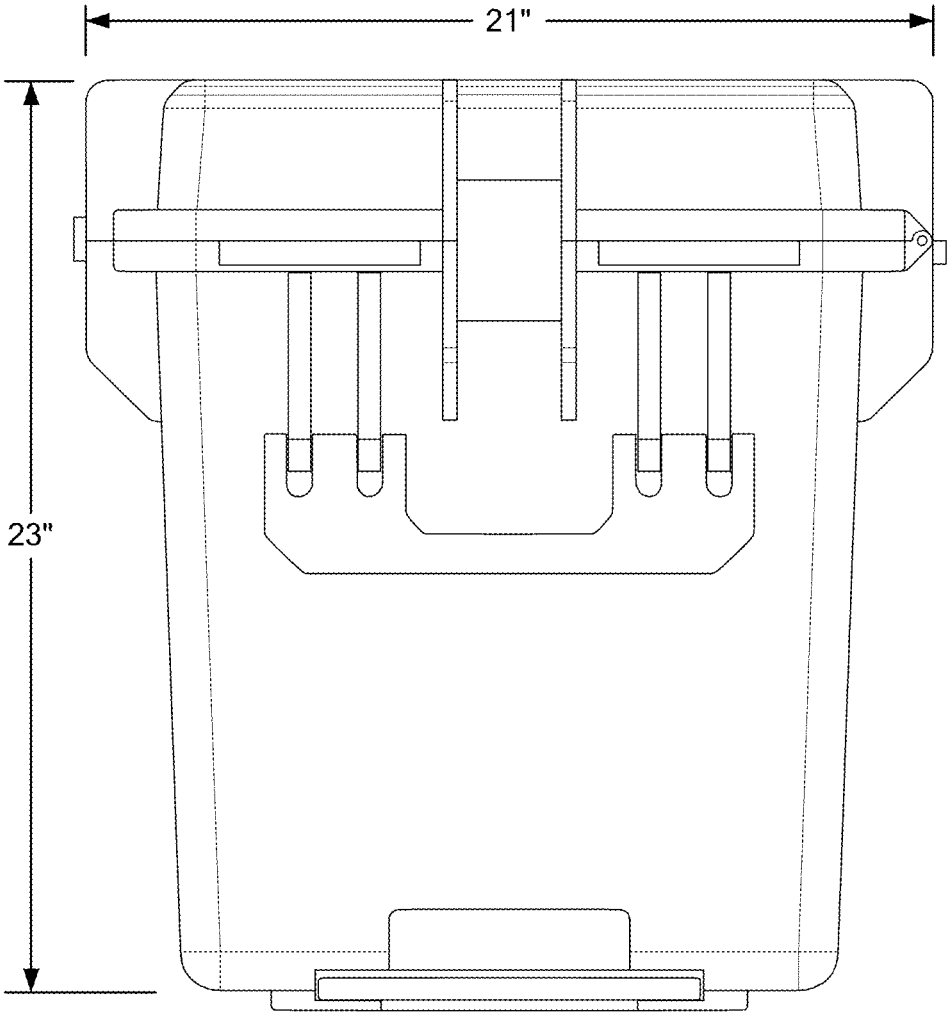
FIG. 5 is an elevation view of the right side of the container of FIG. 1 illustrating the retractable handle at the bottom of the container.
Figure 6:
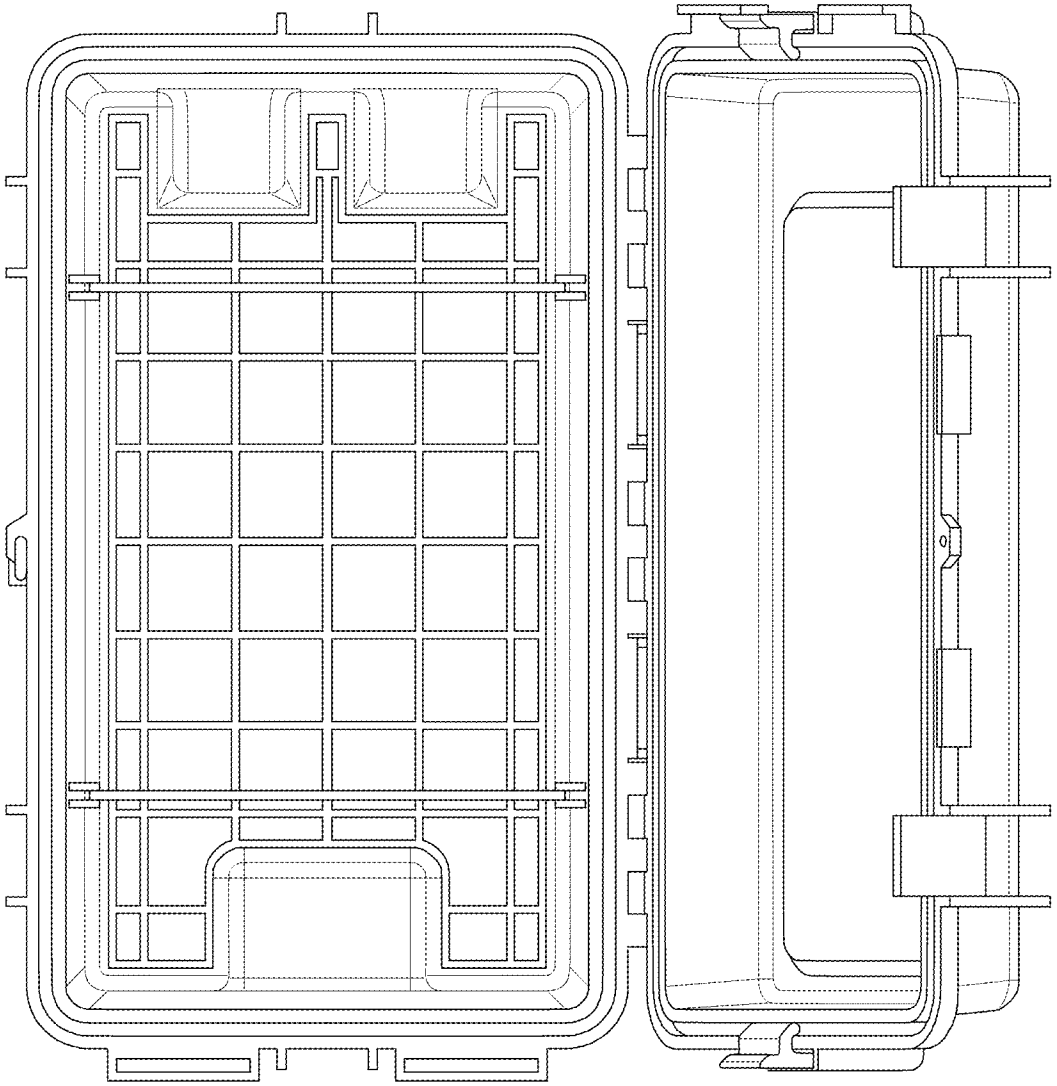
FIG. 6 is a top view of the container of FIG. 1 with the cover in a raised position.
Figure 7:
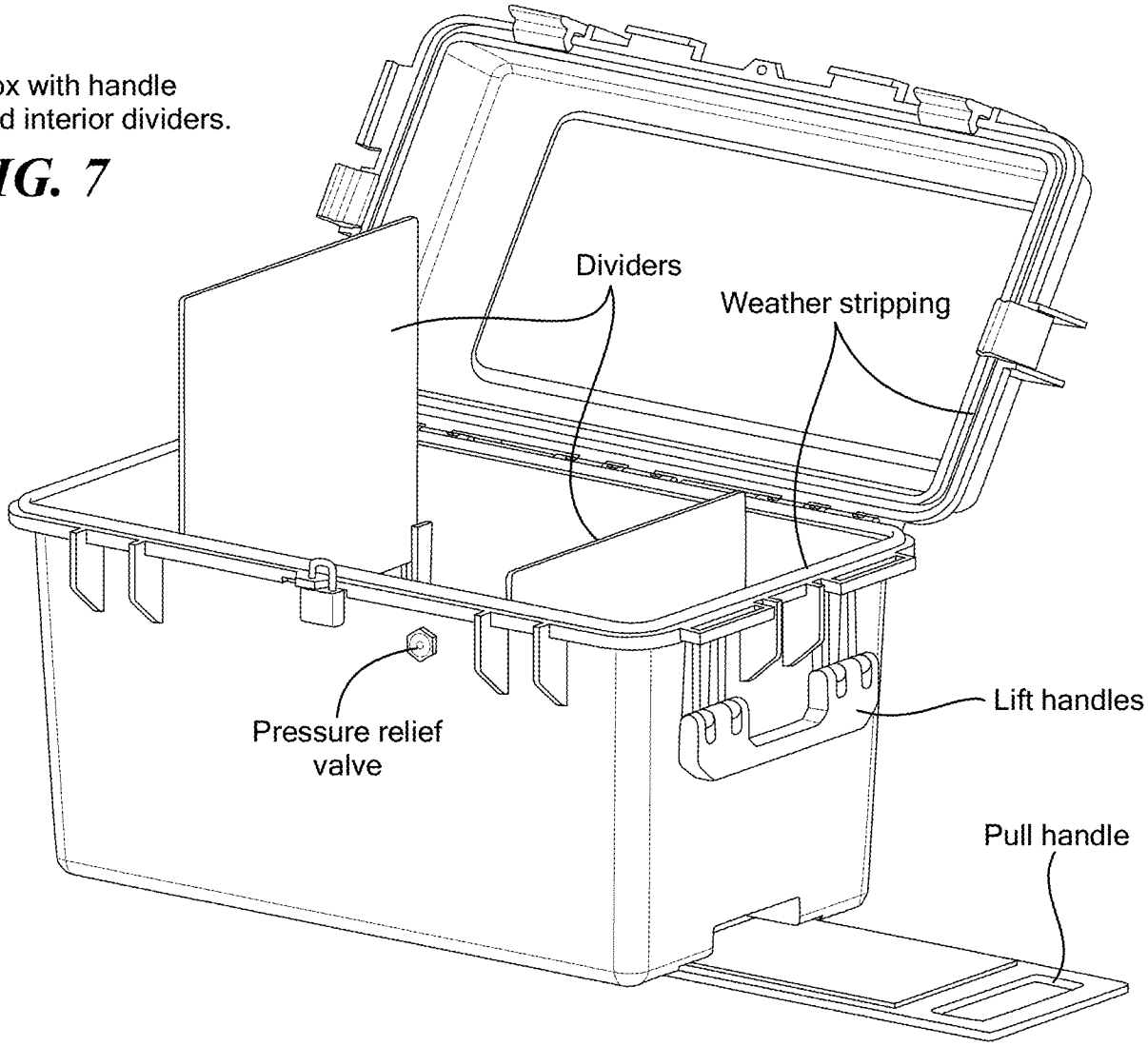
FIG. 7 is a pictorial view of the container of FIG. 1 with the cover open and the pull handle extended for use.
Figure 8:
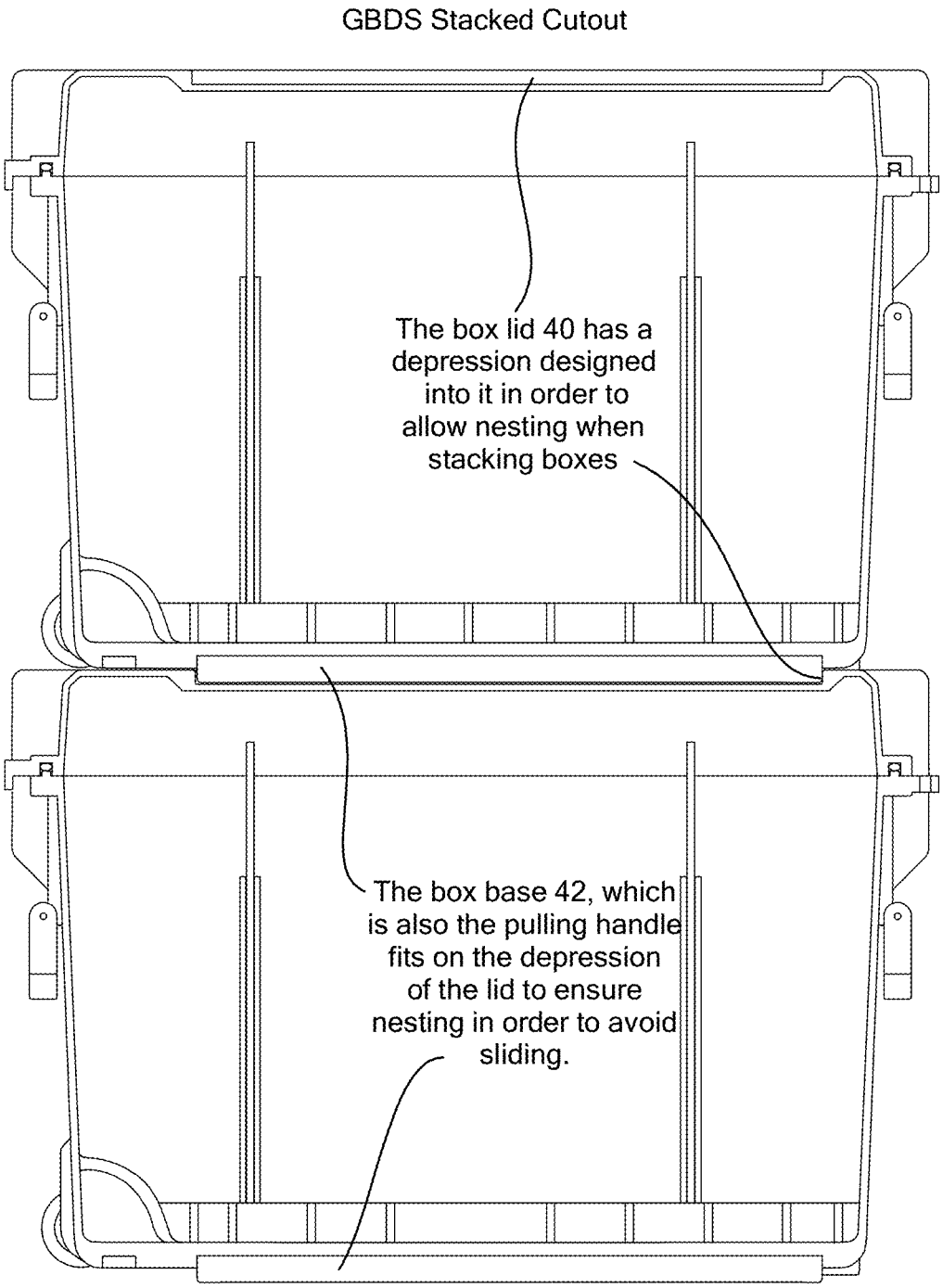
FIG. 8 is an elevation view of two containers stacked one on top of the other.
Figure 9:
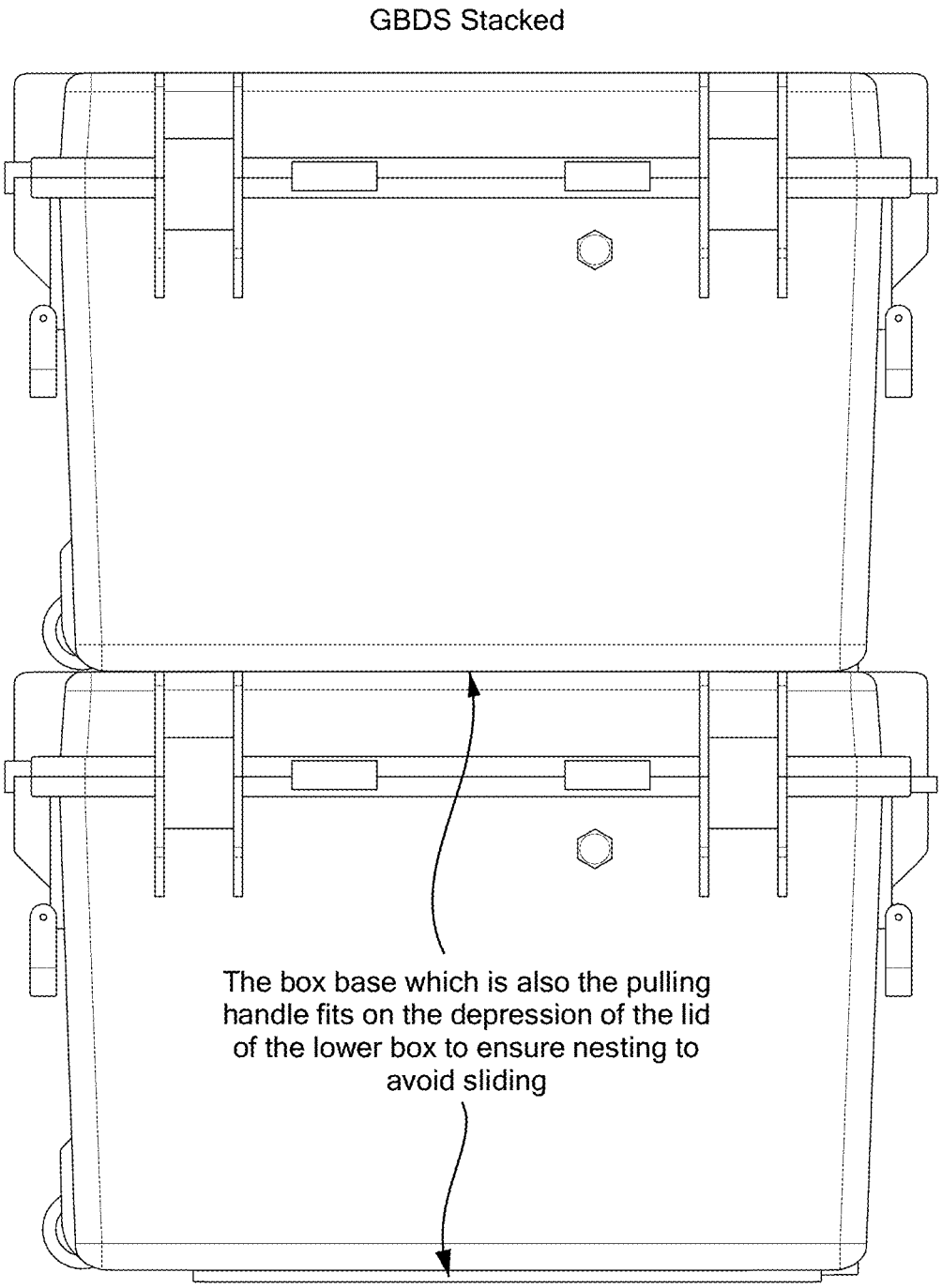
FIG. 9 is an elevation side view of two stacked containers.
Figure 10:
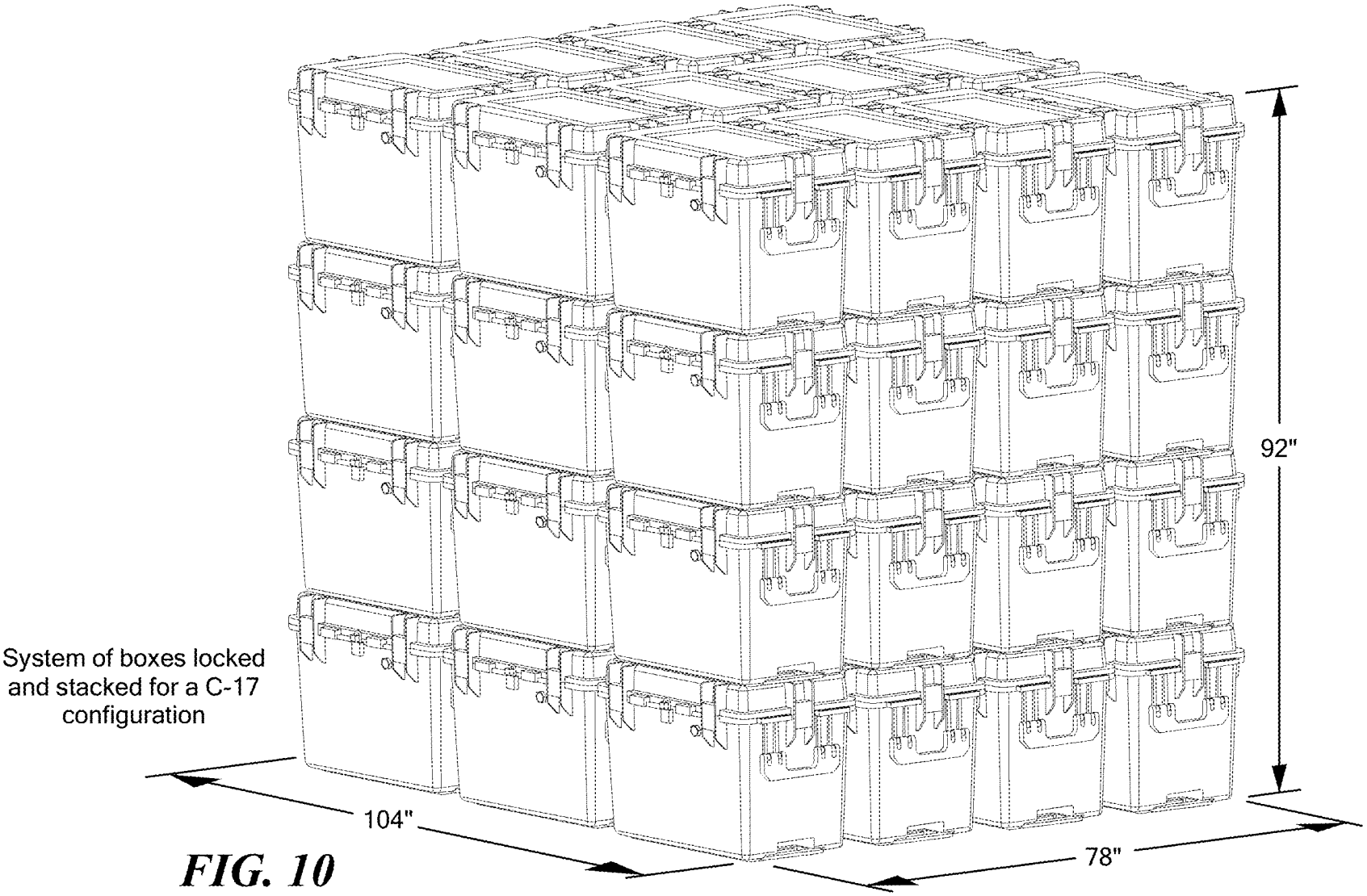
FIG. 10 is a pictorial view of an array of like containers stacked horizontally and vertically.

The top of the cover or lid includes a recessed area 40 as seen in FIG. 1 and FIG. 8 which is sized to accommodate the bottom portion 42 of a like container. When one container is stacked on top of another, the nested arrangement of the recessed top of the lower container and the bottom of the upper container provides a latch against unintended slippage of the upper container in relation to the lower container.

Side-to-side slippage of containers when stacked are prevented by the interconnected slotted tabs on a container and hook tabs on adjacent containers such that the hook and tab arrangement effectively latch the side-by-side containers together so that one cannot slip in relation to the other.

The base or bottom of a container can include a pulling handle which is retracted under the container when not in use and which can be extended outwardly from the container to serve as a handle to move the container via wheels which are provided on the backside of the container, such as shown in FIG. 8.

The container and stacked array of like containers are in a preferred embodiment designed to be employed with a standardized cargo pallet used aboard aircraft such as the 463L pallet used for air cargo. The construction of the containers maximizes the use of the 463L cargo pallet and minimizes dead space thereon. The containers can be labeled to provide at-a-glance identification and ease for inventory and accountability and for adherence to established standards for shipping cargo.

The interior of each box can be configured for various uses at the destination site. For example, the boxes in addition to being storage and shipping containers can be used at a destination for other purposes which include, furniture or furniture elements, coolers, etc.

In one configuration, the box can have inserts which are fitted to serve as a field desk, as a cot or as a cooler, or as a charger for cellphones and other electronic devices. Separators may also be employed to divide the box interior into compartments for holding smaller objects. The boxes may be configured, in one aspect, to hold sensitive materials such as pharmaceuticals or hazardous materials and can be labelled by color code, QR code or otherwise to designate the content therein. The boxes can be labelled to accommodate an inventory control system such that the contents can be looked up or searched and the particular box identified. The inventory control system can be made as an App for use with cellphones, for example, to search for particular boxes in a cargo shipment containing particular contents of interest.

The boxes are not limited to use on a 463L pallet but may be utilized on other pallet systems as well, for civilian and military cargo.

What is claimed is:

1. A pallet system comprising:

a plurality of boxes sized and configured to fit on a standardized air cargo pallet, each box including:

a plurality of sides interconnected to define an interior space;

a lid pivotably connected to at least one of the sides, the lid defining a top of the box;

a base connected to the plurality of sides of the box;

a portion of the base of the box comprising a handle, the handle having a structure being configured for selective extension in a sliding movement in a direction away from the box from a first position to an operative position by which the box can be lifted and moved and the handle being configured for selective retraction in a sliding movement in a direction towards the box from the operative position to the first position;

the lid comprising a recessed area having a closed perimeter formed by a raised portion of the lid and designed to receive the portion of the base including the handle of a like box for nesting when the base of the like box is stacked on top of the lid of the box thereby mitigating against unintended slippage;

at least one of the sides having a first latch element having a structure configured for mating with a corresponding structure of a corresponding second latch element of a like box disposed adjacent to the box in a side by side orientation on the pallet for fastening the box to the like box; and at least one of the sides having a second latch element having a structure configured for mating with a corresponding structure of a corresponding first latch element of a like box disposed adjacent to the box in a back to back orientation on the pallet for fastening the box to the like box.

2. A box for use in a pallet system in which a plurality of like boxes are stackable on a standard air cargo pallet, the box comprising:

a plurality of sides interconnected to define an interior space;

a lid pivotably connected to at least one of the sides, the lid defining a top of the box;

a base connected to the plurality of sides of the box;

a portion of the base of the box comprising a handle, the handle having a structure being configured for selective extension in a sliding movement in a direction away from the box from a first position to an operative position by which the box can be lifted and moved and the handle being configured for selective retraction in a sliding movement in a direction towards the box from the operative position to the first position;

the lid comprising a recessed area having a closed perimeter formed by a raised portion of the lid and designed to receive the portion of the base including the handle of a like box for nesting when the base of the like box is stacked on top of the lid of the box thereby mitigating against unintended slippage;

at least one of the sides having at least one first latch element and at least one second latch element, the at least one first latch element of the box being mateable with a corresponding structure of the at least one second latch element of an other like box disposed adjacent to the box, where at least one portion of the box touches a portion of the other like box.

3. A box according to claim 2 including:

a plurality of wheels attached near the bottom of the box and by which the box can be moved along a supporting surface.

4. A box according to claim 2, wherein the at least one first latch element is disposed on a first portion of one or more sides of the box, and wherein the at least one second latch element is disposed on a second portion of one or more sides of the box.

5. A box according to claim 2 including a pair of handles mounted on respective opposite sides of the box, wherein each handle of the pair of handles is configured for selective pivotable movement relative to each respective side of the box.

6. A box according to claim 2 including at least one separator supported in the interior space of the box to provide compartments for retention of objects placed therein.

7. A box according to claim 2 in which at least one of the sides has an area in which an identification label can be affixed.

8. A box according to claim 2 including at least a portion of an object which is selectively insertable into and removable from the box.

9. The box according to claim 2, wherein the handle comprises at least one element including a cut out area for gripping for selective extension of the handle in the sliding movement in the direction away from the box and for selective retraction of the handle in the sliding movement in the direction towards the box.

* * * * *